US009108769B2

(12) United States Patent
Cahalan

(10) Patent No.: US 9,108,769 B2
(45) Date of Patent: Aug. 18, 2015

(54) ARTICLES DISPENSER

(75) Inventor: Gerard Anthony Cahalan, New Milford, CT (US)

(73) Assignee: Professional Disposables International, Inc., Orangeburg, NY (US)

( * ) Notice: Subject to any disclaimer, the term of this patent is extended or adjusted under 35 U.S.C. 154(b) by 357 days.

(21) Appl. No.: 13/363,042

(22) Filed: Jan. 31, 2012

(65) Prior Publication Data

US 2013/0193159 A1 Aug. 1, 2013

(51) Int. Cl.

| | |
|---|---|
| ***B65D 83/00*** | (2006.01) |
| ***B65D 33/00*** | (2006.01) |
| ***B65D 33/02*** | (2006.01) |
| ***B65D 33/16*** | (2006.01) |
| ***B65D 83/08*** | (2006.01) |
| ***B65D 47/04*** | (2006.01) |

(52) U.S. Cl.

CPC ..... *B65D 33/002* (2013.01); *B65D 33/007* (2013.01); *B65D 33/02* (2013.01); *B65D 33/16* (2013.01); *B65D 47/04* (2013.01); *B65D 83/0805* (2013.01)

(58) Field of Classification Search

CPC .... B65D 33/16; B65D 33/002; B65D 33/007; B65D 33/02; B65D 83/0805; B65D 47/04

USPC ..... 221/64, 282, 208; 222/207; 220/235, 220/234

See application file for complete search history.

(56) References Cited

U.S. PATENT DOCUMENTS

| | | | | | |
|---|---|---|---|---|---|
| 2,107,939 | A | * | 2/1938 | Hartnack | 217/109 |
| 2,750,601 | A | * | 6/1956 | Houle | 4/295 |
| 2,824,577 | A | * | 2/1958 | Grunsky | 138/90 |
| 3,618,809 | A | * | 11/1971 | Martino | 220/235 |
| 3,750,822 | A | * | 8/1973 | Dubach | 215/361 |
| 4,175,671 | A | * | 11/1979 | Holl et al. | 220/235 |
| 4,867,576 | A | | 9/1989 | Boyd | |
| 4,941,754 | A | | 7/1990 | Murdock | |
| 4,993,246 | A | * | 2/1991 | Kopper | 70/166 |
| 5,000,348 | A | | 3/1991 | Emody | |
| 5,044,403 | A | * | 9/1991 | Chen | 138/89 |
| 5,131,553 | A | * | 7/1992 | Geasland | 220/235 |
| 5,273,186 | A | | 12/1993 | Widmer | |
| 5,307,841 | A | * | 5/1994 | Condon | 138/90 |
| 5,476,322 | A | | 12/1995 | Stoody | |
| 5,875,936 | A | | 3/1999 | Turbett et al. | |
| 5,931,516 | A | * | 8/1999 | Holtman et al. | 292/257 |
| 6,022,144 | A | | 2/2000 | Hausslein | |
| 6,035,898 | A | * | 3/2000 | Dominguez | 138/89 |
| 6,158,614 | A | | 12/2000 | Haines et al. | |
| 6,193,093 | B1 | * | 2/2001 | Brunner | 220/234 |
| 6,220,435 | B1 | * | 4/2001 | Nobile et al. | 206/409 |
| 6,234,674 | B1 | | 5/2001 | Byers, Jr. | |
| 6,419,104 | B1 | * | 7/2002 | Sarajian | 220/234 |
| 6,508,587 | B1 | | 1/2003 | Byers, Jr. | |
| 6,585,130 | B2 | | 7/2003 | Turbett et al. | |

(Continued)

*Primary Examiner* — Rakesh Kumar

(74) *Attorney, Agent, or Firm* — Christie, Parker & Hale, LLP

(57) ABSTRACT

A dispenser includes a housing; and an adapter within the housing and configured to be removably coupled to a container, the adapter having a base having a substantially planar surface and an arm extending from the surface; a collar on the arm and movable with respect to the arm; and a sleeve on the arm and contacting the collar, wherein the adapter can be moved between an insertion orientation in which the sleeve has a first outer diameter and a coupling orientation in which the sleeve has a second outer diameter that is greater than the first outer diameter.

18 Claims, 12 Drawing Sheets

(56) References Cited

U.S. PATENT DOCUMENTS

| | | | | |
|---|---|---|---|---|
| 6,607,087 | B2 * | 8/2003 | Turnwald | 215/360 |
| 6,659,513 | B1 * | 12/2003 | Ramsauer | 292/66 |
| 6,883,546 | B1 * | 4/2005 | Kobylinski | 138/89 |
| 7,025,220 | B2 | 4/2006 | Verespej et al. | |
| 7,731,043 | B2 * | 6/2010 | Wang Wu | 215/355 |
| 7,942,105 | B1 * | 5/2011 | Dolton | 114/197 |
| 7,971,852 | B2 * | 7/2011 | Otsubo et al. | 251/144 |
| 8,037,904 | B2 * | 10/2011 | Carnevali | 138/89 |
| 8,137,039 | B2 * | 3/2012 | Liang et al. | 411/34 |
| 8,186,527 | B2 * | 5/2012 | Liu | 215/317 |
| 2006/0266761 | A1 | 11/2006 | Rhea | |
| 2010/0212094 | A1 | 8/2010 | Cohen | |

* cited by examiner

ARTICLES DISPENSER

BACKGROUND

1. Field

Embodiments of the present invention relate generally to dispensers, and more specifically to dispensers for thin and flexible articles.

2. Description of Related Art

Wipes, tissues, towelettes, and napkins are frequently used in hospitals, restrooms, and other places in which the application of a cleaning or disinfectant substance on a wiping mechanism is desirable. Often, such items are packaged in either rigid containers and/or in one-time use containers. Rigid containers often contain a significant amount of unused or "dead" space that takes up a relatively large area during transportation and storage, which typically increases the cost of transporting and storing the containers in addition to requiring additional space. Further, one-time use containers may require individual dispensing mechanisms to be associated with each container, such dispensing mechanism adding to the cost of the container, requiring additional materials, and occupying more space than if it were omitted from the container.

SUMMARY

According to an embodiment of the present invention, a dispenser is provided including a housing; and an adapter within the housing and configured to be removably coupled to a container, the adapter having a base having a substantially planar surface and an arm extending from the surface; a collar on the arm and movable with respect to the arm; and a sleeve on the arm and contacting the collar, wherein the adapter can be moved between an insertion orientation in which the sleeve has a first outer diameter and a coupling orientation in which the sleeve has a second outer diameter that is greater than the first outer diameter.

In one embodiment, the adapter further includes a stopper on the arm, wherein the sleeve is between the collar and the stopper. The stopper has an outer diameter greater than the first outer diameter of the sleeve and smaller than the second outer diameter of the sleeve.

In one embodiment, the dispenser may further include an actuator for moving the adapter between the insertion orientation and the coupling orientation. The actuator may include a handle and a pair of tines, wherein the tines narrowingly taper in a direction away from the handle.

Further, the actuator may be generally between the planar surface of the base and the collar when the dispenser is in the coupling orientation.

In one embodiment, the dispenser has an opening extending therethrough to allow removal of the articles from the housing. Further, the collar is configured to slide along the arm of the adapter to move between the insertion orientation and the coupling orientation. The collar can influence the sleeve to change diameters when the adapter is moved between the insertion orientation and the coupling orientation.

In one embodiment, the dispenser includes a container coupled to the adapter. The container can be coupled by an interference fit to the adapter in the coupling orientation, and the container is relatively flexible and has an opening that extends less than an entire width of the container, wherein a diameter of the opening is substantially similar to a diameter of the arm of the adapter. In one embodiment, a portion of the arm is within the container and the sleeve contacts the container.

DETAILED DESCRIPTION

Figure 1:
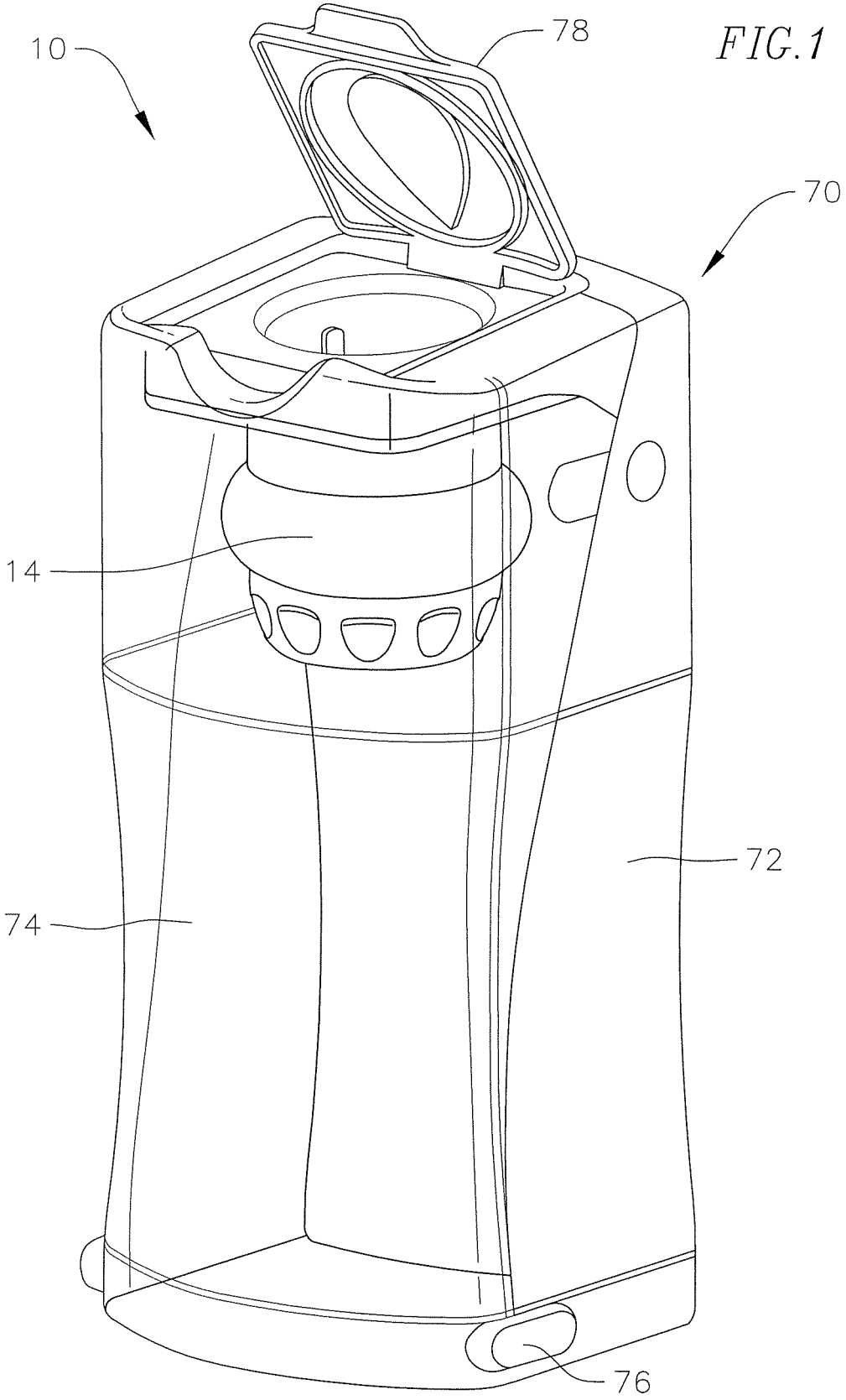
FIG. 1 is a perspective view of a dispenser according to an embodiment of the present invention.

Embodiments of the present invention are generally directed to a dispenser for articles. Although the dispenser can be used with dry or impregnated articles, it is particularly useful for dispensing moisture-impregnated articles. For purposes of the present invention "moisture-impregnated articles" is defined to include articles impregnated with at least one substance selected from the group consisting of water, a surface cleaner, a cleaning composition capable of attracting particulate matter, a medicament, skin cleanser, skin moisturizer, skin lotion, and antiseptic.

The "articles" usefully employed with a dispenser of the present invention include natural and/or synthetic cloth or paper sheets. Such articles include paper products such as tissues and woven and nonwoven products, the latter based on natural or synthetic fibers and mixtures thereof. The dispenser can contain articles such that the dispenser is either disposable or refillable. By "disposable" is meant a dispensing package containing a supply of articles intended to be discarded after the plurality of articles supplied therewith is depleted, i.e., the dispensing package is not intended to be restocked with such articles. Likewise, each article is discarded after use, and is not laundered, or otherwise restored. By "refillable" it is meant that the dispensing package is or may be restocked with articles after the supply is depleted.

Each article, i.e., an individual article, is releasably attached to each previous and subsequent article (except, respectively, for the first and last) by any releasable attachment means which allows easy separation to occur as the article is being dispensed or after the article is withdrawn through the dispensing element. The releasable attachment means may comprise adhesively joining the article to the adjacent articles with an adhesive that is suitable for use with the impregnant present on or in the article as well as with skin (where the impregnated article is intended to be used in contact with skin). "Releasably attached" means each article is easily separated from adjacent article, and may include releasable attachment means such as friction, cohesion, or other forces that releasably attach adjacent articles. Where articles are interleaved, releasable attachment results from friction or cohesion between adjacent articles. In one embodiment, each article is releasably attached to an adjacent article by a plurality of frangible lands. As used herein a "land" refers to a small connection separated by cuts and joining adjacent articles. Lands are considered to be "frangible" if, upon separation of one article from an adjacent article in tension, the lands break prior to significant ripping or tearing of either article. The articles may be connected by a plurality of lands. The number and size of the lands and cuts will vary depending on the type and composition of the article, e.g., whether an article is comprised of paper, cloth, non-woven synthetic fibers, etc. and whether it is dry or impregnated. Limited experimentation by one skilled in the art will readily determine the appropriate configuration to assure separation of the articles without undue tearing as well as assuring that the article is dispensed through the dispenser opening to assure availability of the succeeding article.

Figure 2:
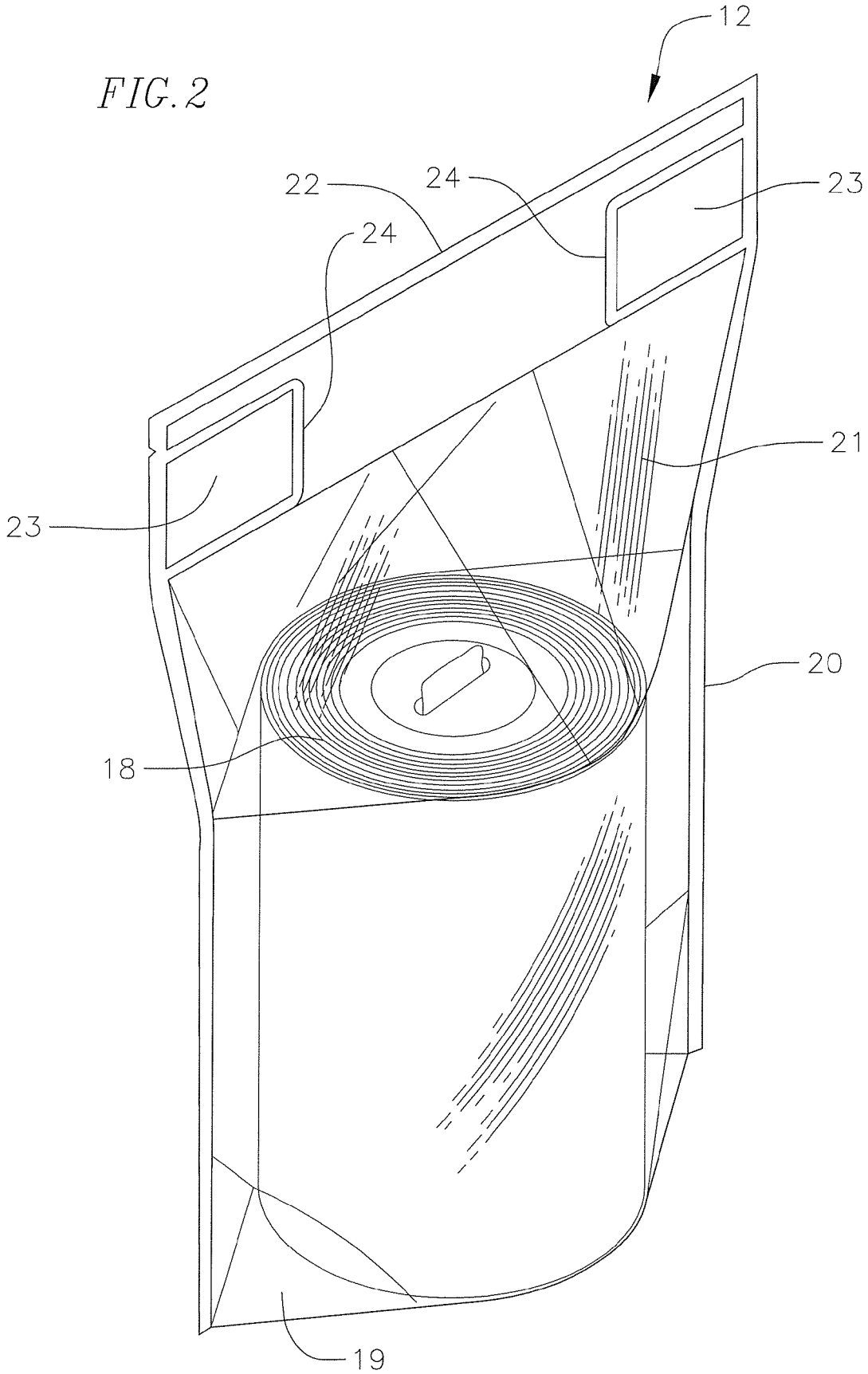
FIG. 2 is a perspective view of an embodiment of a container configured to be used with the dispenser according to an embodiment of the present invention.
Figure 3:
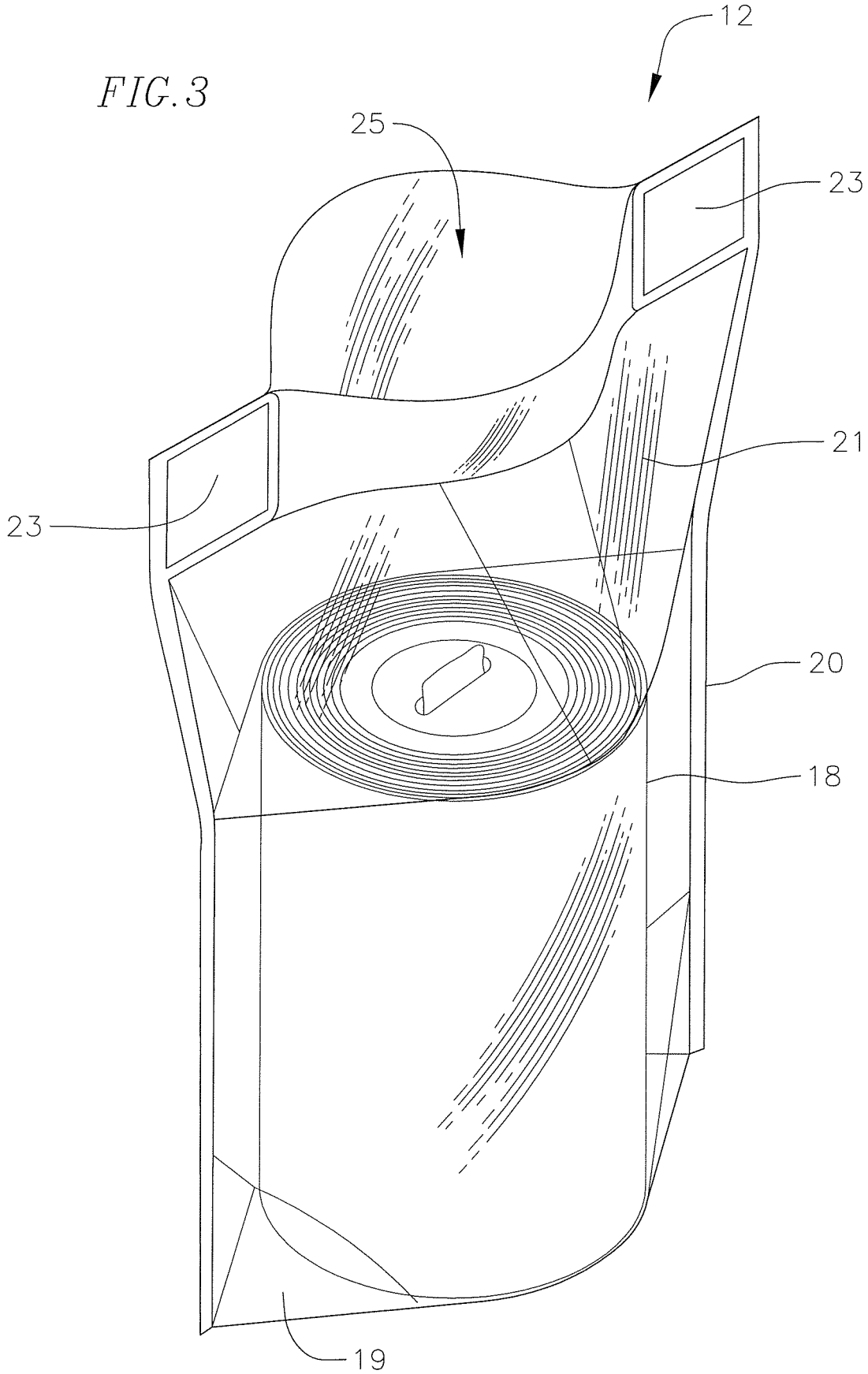
FIG. 3 is a perspective view of the container of FIG. 2 opened and ready to be accommodated into the dispenser of FIG. 1.

With reference now to FIGS. 1-3, an embodiment of a dispenser 10 includes a housing 70 and an adapter 14 within the housing and configured to be removably coupled to the container.

Additionally, a container 12 (FIG. 2) may be accommodated within the housing and dimensioned to accommodate articles 18, such as wipes, which can be removed from the dispenser and used as desired. In general, as shown in the figures, the adapter 14 is configured to be removably coupled to the container 12 so that the adapter can be used with successive containers as each container is emptied of articles or so that it can be reused with the same container if that container is refilled.

Figure 5:
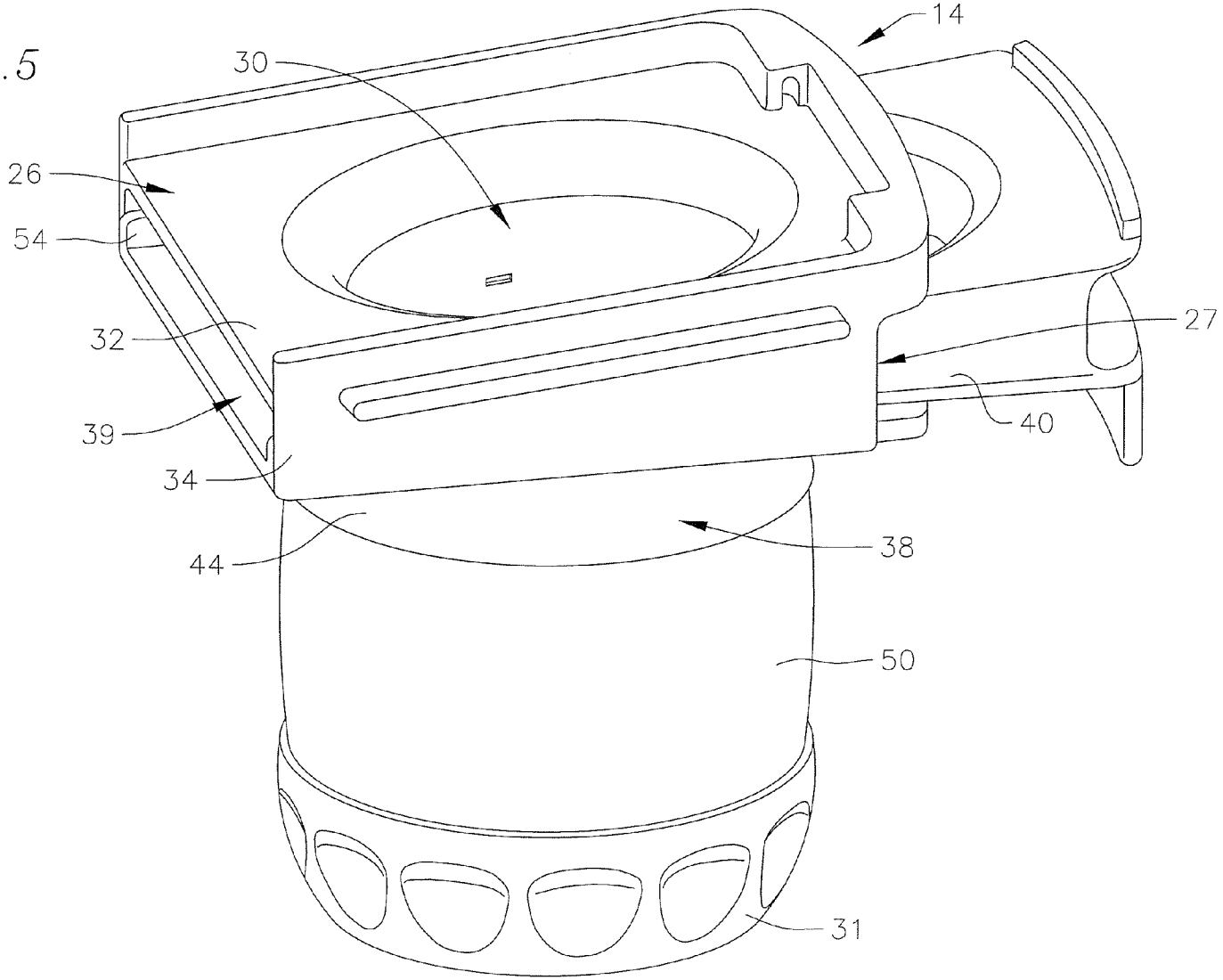
FIG. 5 is a perspective view of an adapter of the dispenser of FIG. 1 in an insertion orientation according to an embodiment of the present invention.

According to one embodiment and as described in more detail below, to couple the adapter 14 to the container 12, the container is inserted onto a lower portion of the adapter through an opening 25 on the container. Then, an actuator 40 can be inserted into the adapter 14 and used to displace a collar 38 (FIG. 5). Displacement of the collar 38 results in a compressive force being applied along a longitudinal axis of a sleeve 50, forcing the sleeve to expand along its lateral axis and to contact interior walls of the container 12 defining the opening 25, thereby securing the adapter to the container 12.

As shown in FIG. 1, the housing 70 accommodates the adapter 14 and the container 12 therein. In one embodiment, the housing 70 is generally hexahedral and includes a base 72 that can be configured to be coupled to a wall or other flat surface to support the housing and a cover 74 movable with respect to the base and defining a cavity configured to accommodate the adapter 14 and the container 12. As will be appreciated, the dispenser 10 does not need to be attached to a wall or any other support to function as intended, but rather the dispenser can be used as a stand-alone device.

In one embodiment, the cover 74 is pivotably coupled to the base 72 at a lower end coupling 76 of the cover and can be rotated about the coupling between an open position, in which the container 12 can be inserted into the housing, and a closed position wherein the housing substantially seals the container within the housing. Further, the cover 74 can have a shape generally corresponding to a shape of the base 72 and can form an interference fit with the base to provide a generally sealed cavity when the cover is in the closed position. The cover 74 is also dimensioned to accommodate the adapter 14 and is configured to engage the adapter to be coupled thereto. As will be appreciated, although a particular embodiment of the housing 70 has been described, the dispenser 10 can be used with any protective housing having one of a variety of configurations, dimensions, and orientations, or the dispenser can be used without any outer housing at all.

With reference now to FIGS. 2 and 3, the container 12 is dimensioned to house a number of articles 18 therein and is configured to be coupled to the adapter 14. In one embodiment, the container 12 comprises a bag made from a relatively flexible material, such as a thin resin plastic. A dispenser accommodating articles packaged in a flexible container allows the articles to be shipped and stored more economically because of the ability of the container to be folded and fit into a smaller area with less "wasted" (i.e., unused) space than articles packaged in rigid containers. Further, in one embodiment, the container 12 is transparent so that a user can identify approximately how many articles are left in the container and can therefore more economically plan for any necessary refills or additional containers. However, the container 12 can be made from any suitable material and may have any appropriate properties to house a number of articles.

In one embodiment, the articles 18 are housed in the container 12 in the form of a "log roll," including interleaved or otherwise connected articles rolled up into a cylindrical shape. However the articles 18 may also be housed in the container in a stack or any other appropriate configuration.

In its simplest form, any container configured to contain articles and having an opening able to be coupled to the adapter can be used in accordance with embodiments of the dispenser 10. However, with reference to FIG. 2, a specific embodiment of the container 12 is designed to accommodate a log roll of articles having a greater initial diameter than a diameter of the adapter.

As such, the dispenser is not limited only to a number of articles that result in a log roll with a relatively small diameter. The container 12 includes a bottom wall 19 and is sealed along side edges 20 thereby creating opposing side walls 21. Before the articles 18 are inserted into the container 12, the container 12 includes a top opening that extends across an entire length of the container to allow a log of articles to be inserted into the container, wherein the diameter of the log roll is restricted only by the dimensions of the container 12, but not by an opening 25 (FIG. 3) that will be accommodated by the adapter 14. After the articles 18 have been inserted into the container and the articles have been impregnated with a liquid, if desired, the top opening is sealed. During the sealing process, a top seal 22 is formed across the entire top edge of the bag. Additionally, two side welds 23 are formed by sealing portions of the side walls 21 together, such as by hot melting them together, each side weld being a generally rectangular shape and spaced from the top seal 22. The side welds 23 abut opposing the side edges 20 of the bag on their lateral sides and are spaced from each other on their medial sides 24 thereby defining the opening 25 between the two side welds 23.

With reference now also to FIG. 3, the container 12 can be opened by tearing the container between the top seal 22 and the side welds 23, thereby exposing the opening 25 which is defined by the side welds and has a width smaller than an entire width of the container. As described in more detail below, the opening 25 is sized such that the adapter 14 can be coupled by to an inner periphery of the walls of the opening to attach the container 24 to the adapter. Further, the opening 25 allows the articles 18 within the container to be removed therefrom through the dispenser 10. It will be appreciated that although a container 12 with a specific opening design has been described herein, any suitable container with an opening could be coupled to the adapter 14.

The adapter 14 generally serves to provide support to the container 12 and includes a coupling mechanism to couple the container to the adapter. Further, the adapter 14 is configured to allow a user to remove the articles 18 from the container, as shown in one embodiment with reference to FIGS. 4-6. The adapter 14 is made from a generally rigid material, for example molded resin, that allows the adapter to support the flexible container 12. In one embodiment, the adapter 14 includes a base 26 and an arm 28 extending from the base and configured to accommodate the container 12. The arm 28 is substantially cylindrical and has an opening 30 extending therethrough, the opening being adapted to allow the articles 18 to be removed from the container 12 when the container is attached to the adapter 14. In one embodiment, the opening 30 may be configured with an insert to provide, for example, an X-shape or cross shape which aids in separating successive articles as they are removed from the container 12. An exterior surface of the arm 28 is generally smooth to accommodate the collar 38 (FIG. 5) that extends around a periphery of the arm and can slide along the aim, as described in more detail below.

The base 26 generally extends from a periphery of one end of the arm 28, for example the upper end. In one embodiment, the base 26 includes a substantially planar surface 32 extending at an angle from the arm 28. For example, if the arm 28 is oriented vertically, the planar surface 32 is angled between about 5 and about 20 degrees from the horizon to accommodate an actuator 40, as described in more detail below. The base 26 is generally angled downward from an insertion side 27 of the adapter 14, the insertion side being the side into which the actuator 40 is inserted to actuate the coupling mechanism of the adapter.

Integral side walls 34 extend substantially perpendicularly in two directions (e.g., upward and downward) from edges of the planar surface 32. The lower portion 35 (i.e., the portion below the surface 32) of the side walls 34 form sides of a channel 39 (FIG. 6) along with side walls 54 of the collar 38 to accommodate the actuator 40, as described below, while the upper portion 37 (i.e., the portion above the surface 32) is configured to accommodate a lid 78 of the dispenser 10 (FIG. 1). In one embodiment, the lid 78 is accommodated proximate one edge of the top of the adapter 14 and is rotatably coupled to the adapter via recesses 80.

Figure 4:
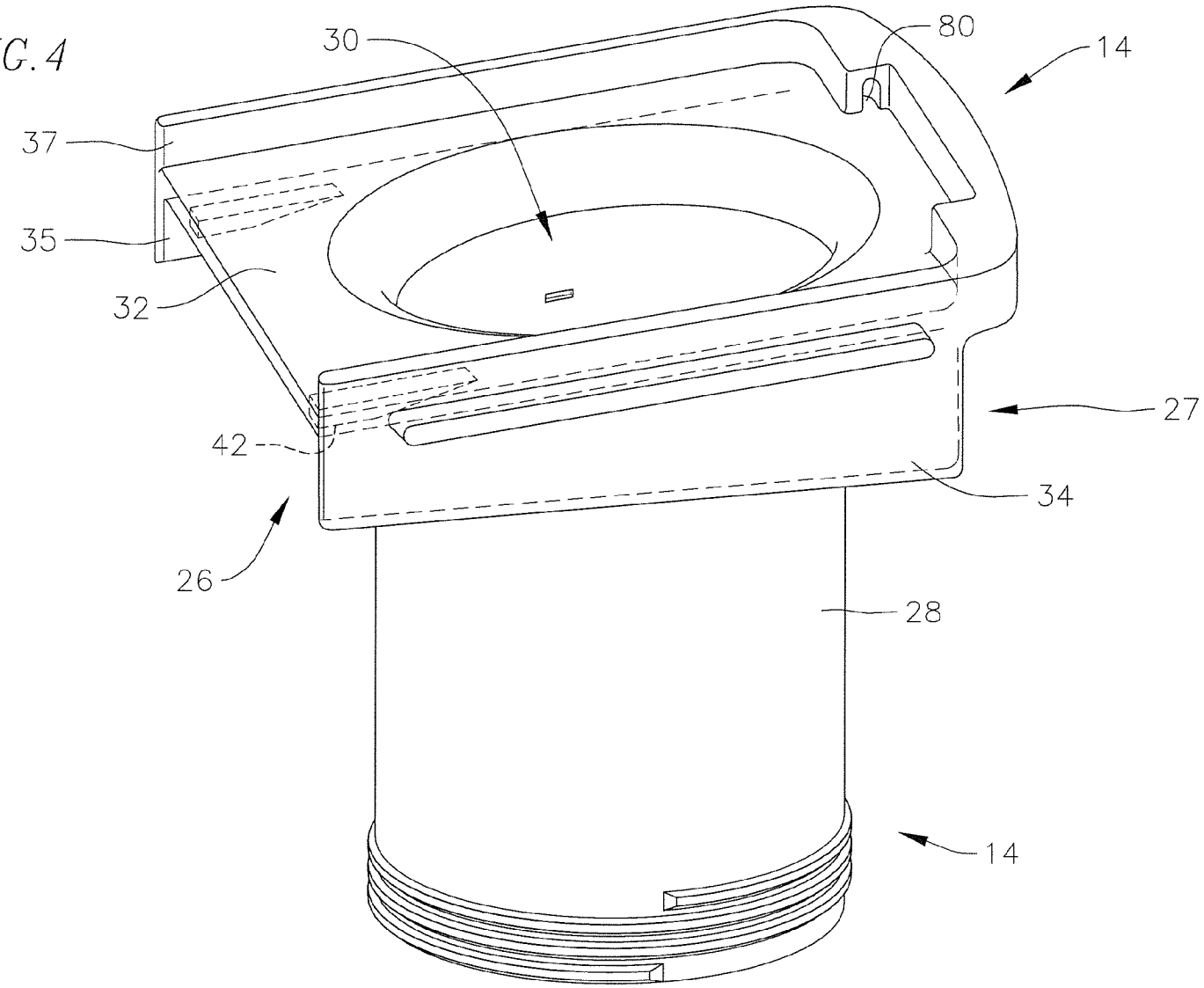
FIG. 4 is a perspective view of an embodiment of a base of an adapter of the dispenser of FIG. 1.

As shown in FIG. 4, a pair of ramps 42 extend along a bottom portion of the planar surface 32. In one embodiment, the ramps 42 are substantially wedged-shaped extending at an angle from the surface 32 for a certain distance and terminating at a constant height at a distal end. The ramps 42 are located on the surface 32 at a side generally opposite to the insertion side 27 of the adapter 14 and are oriented such that the leading edge meets the actuator 40 first as the actuator is inserted. The ramps 42 help to further move the collar 38 toward the stopper 31 when the actuator 40 is inserted between the base 26 and the collar 38, although it will be appreciated that the adapter 14 would also work without the ramps or with ramps of a different configuration.

With continued reference to FIG. 4, a lower end of the arm 28 may be threaded for coupling a stopper 31 (FIG. 5), such as a nut, thereto. The stopper 31 is affixed to the lower portion of the arm 28 and has a greater exterior diameter than the arm to prevent the sleeve 50 and the collar 38 from sliding off the arm. Additionally, the stopper 31 may have an annular recess 33 (FIG. 8) to accommodate the sleeve 50, as described below. The threaded portion of the aim 28 allows the stopper 31 to be removed if necessary, for example, to replace the sleeve 50 or the collar 38 mounted on the arm. Alternatively, the arm 28 may be entirely smooth and any stopper having an exterior diameter greater than a diameter of the arm can be coupled thereto using, for example, an adhesive, providing a more permanent attachment, or the arm and the stopper may be integral as a single piece. As will be appreciated, although the arm 28 and opening 30 are both shown as cylindrical, the specific shape of the arm and the opening is not critical and further, the arm and the opening do not necessarily need to have the same shape.

Figure 6:
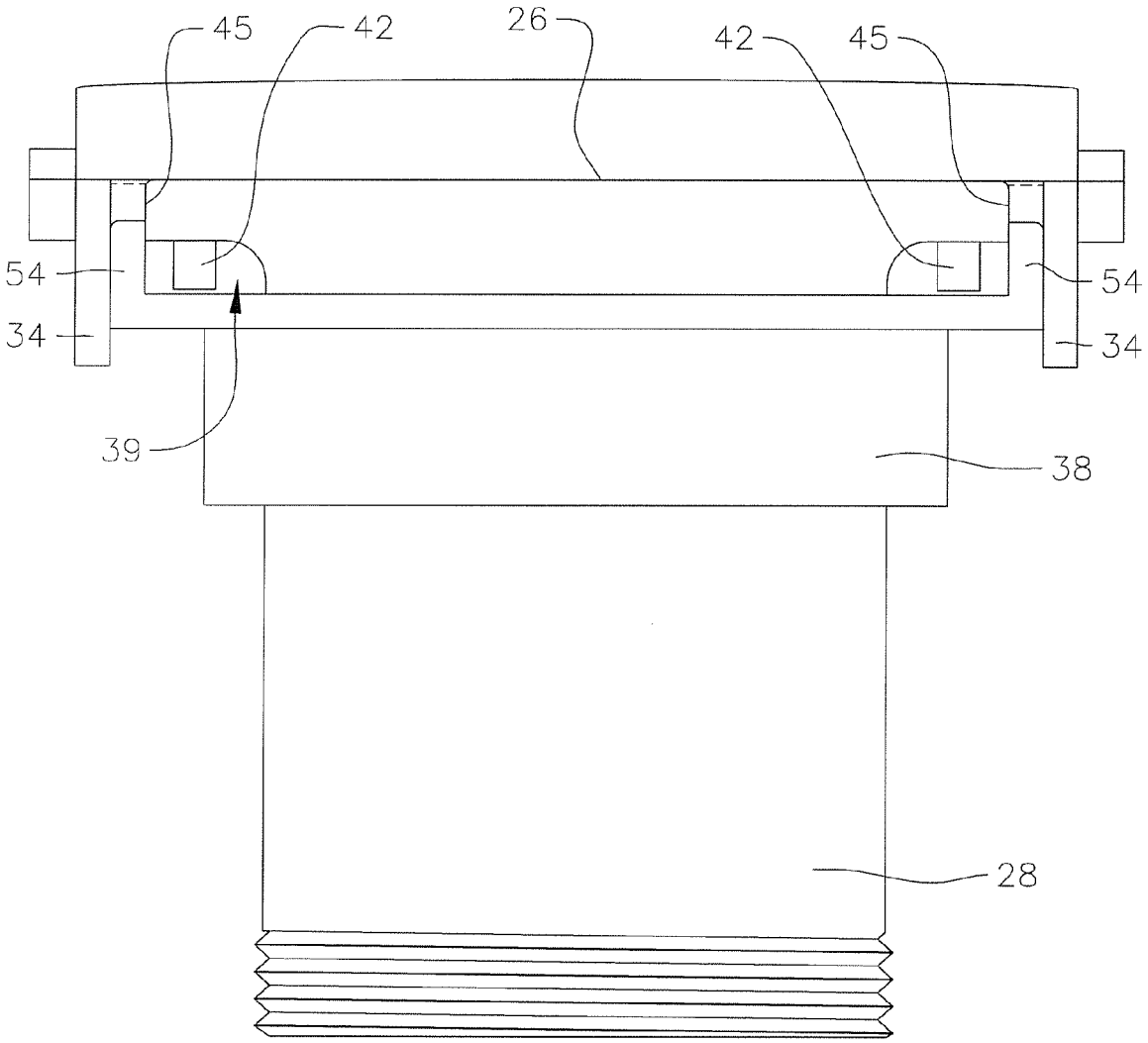
FIG. 6 is a rear view of a portion of the dispenser of FIG. 1.

With reference now to FIG. 6, the insertion side 27 of the base 26 is shown from which the actuator 40 is inserted to actuate the coupling mechanism of the adapter 14. A pair of detents 45 are located on the bottom portion of the surface 32 proximate the insertion side and extend into the channel 39 formed by the base 26 and the collar 38. The detents 45 are configured to engage the actuator 40 when the actuator is inserted into the base 26, and accordingly, the actuator 40 can be fixedly coupled to the base 26. If desired, the actuator 40 can be separated from the base 26 by a user by manually pressing down on the collar 38 such that the collar moves below the detents 45 and then sliding the actuator out from between the collar and the detents.

Figure 7:
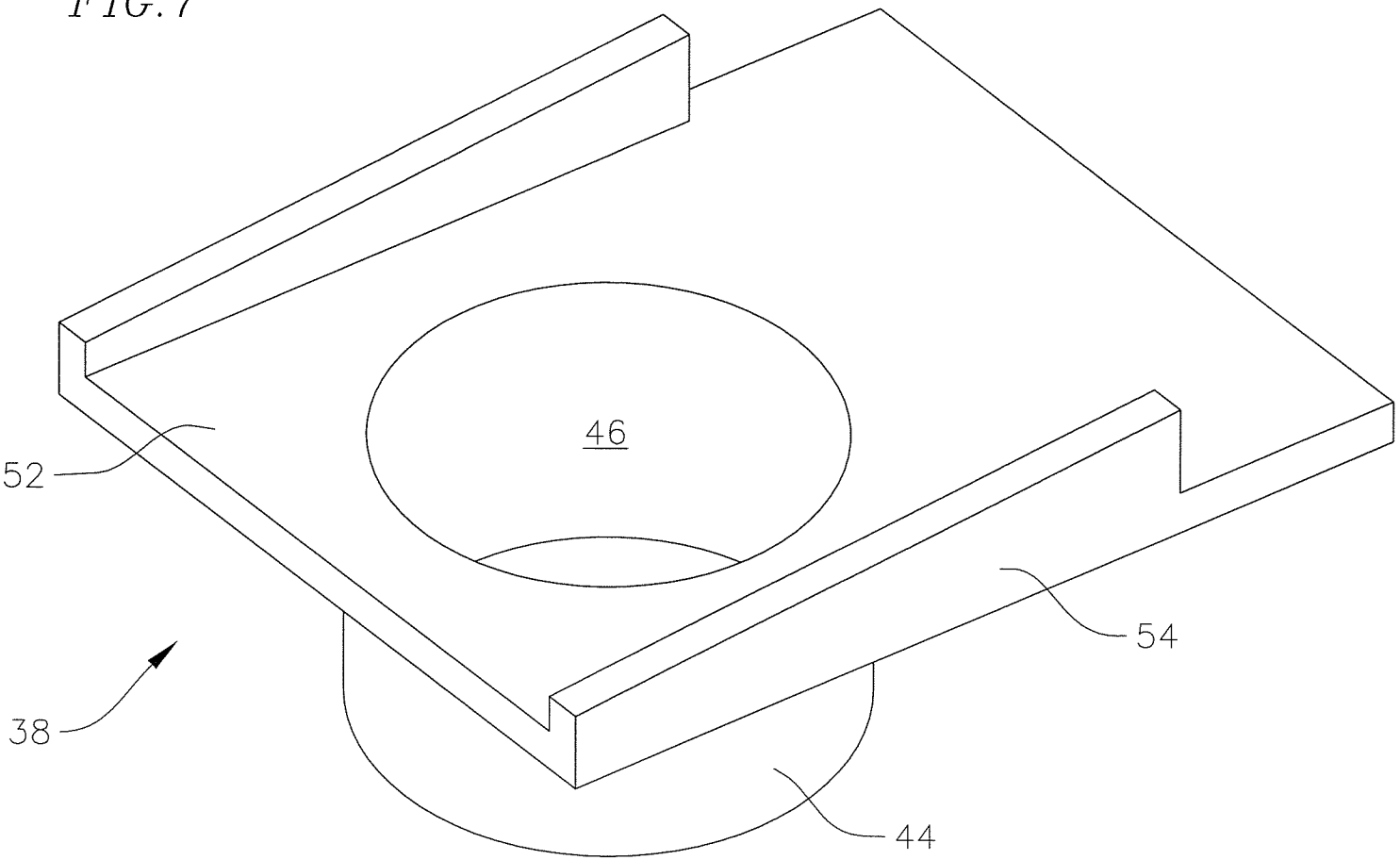
FIG. 7 is a perspective view of a collar of the adapter of FIG. 5 according to an embodiment of the present invention.
Figure 8:
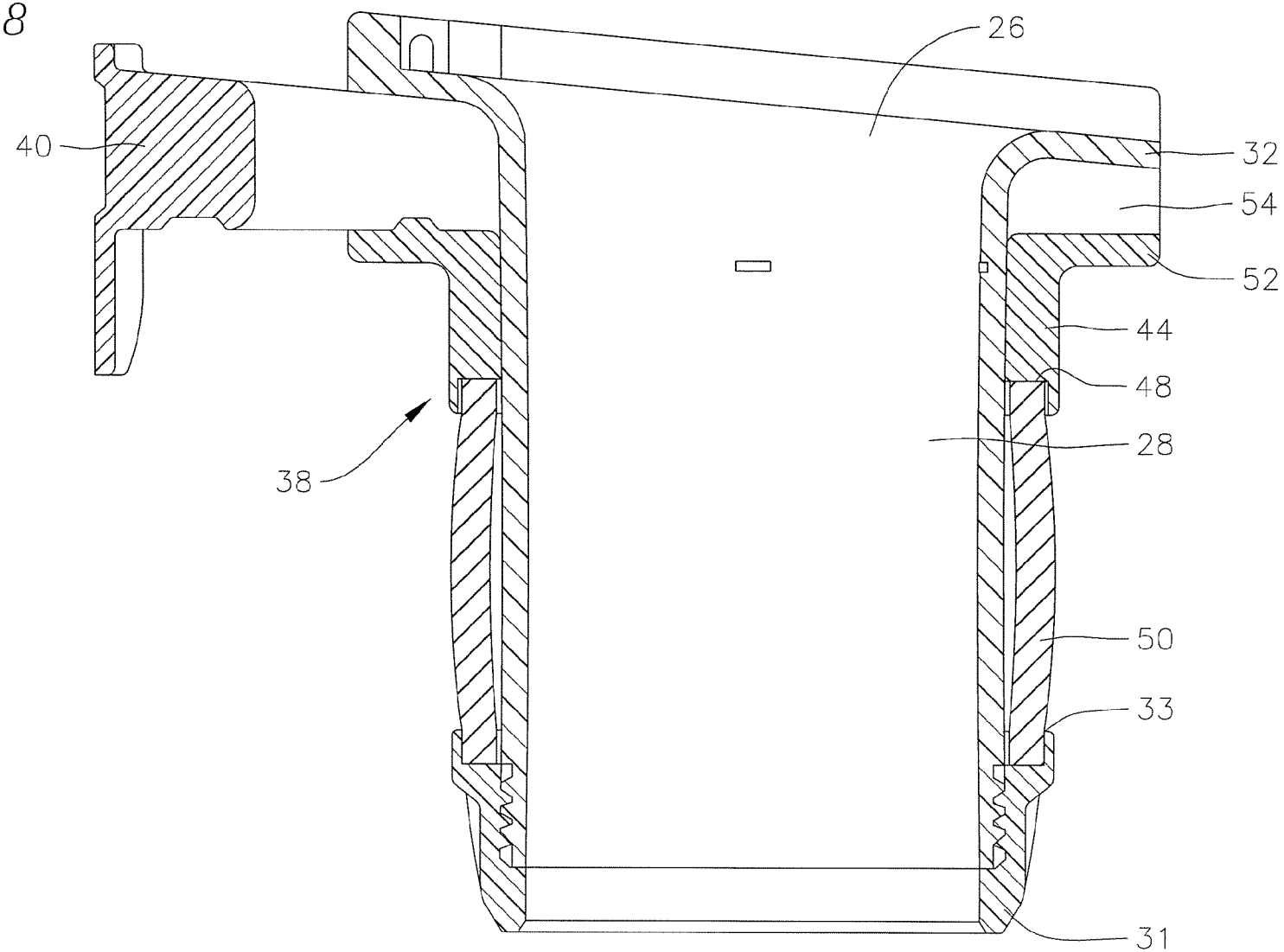
FIG. 8 is a cross-sectional view of the adapter of FIG. 5 in the insertion orientation.

The collar 38 is provided on the adapter 14 generally between the base 26 and the stopper 31. With reference to FIGS. 7 and 8, the collar 38 includes a neck 44 having an opening 46 which has a diameter slightly larger than a diameter of the arm 28 of the adapter 14 to allow the collar 38 to slide along the arm. In one embodiment, the neck 44 has a shoulder 48 at a lower end of the collar 38 extending around an inner periphery of the neck 44, wherein the shoulder 48 is configured to abut an end of the sleeve 50 so that when the collar 38 is moved toward the stopper 31, the shoulder compresses the sleeve 50 in the longitudinal direction and forces the sleeve to expand in the lateral direction.

An upper portion of the collar 38 includes a flange 52 extending from a periphery of the neck 44, wherein the flange is dimensioned to have a slightly smaller area than an area of the surface 32 of the base 26. The flange 52 has a pair of opposing side walls 54 that are adjacent to and may abut the interior of respective side walls 34 of the base 26 when the adapter is in the insertion position. As shown in FIG. 7, the side walls 54 slope downward from one end of the flange 52 toward the other end to generally match the contour of the side walls 34 of the base 26. As noted above and as shown in FIG. 6, the side walls 34 of the base 26 and the side walls 54 of the collar 38 together form a channel 39 configured to accommodate the actuator 40 with the surface 32 forming the top of the channel and the flange 52 of the collar 38 forming the bottom of the channel.

Figure 9:
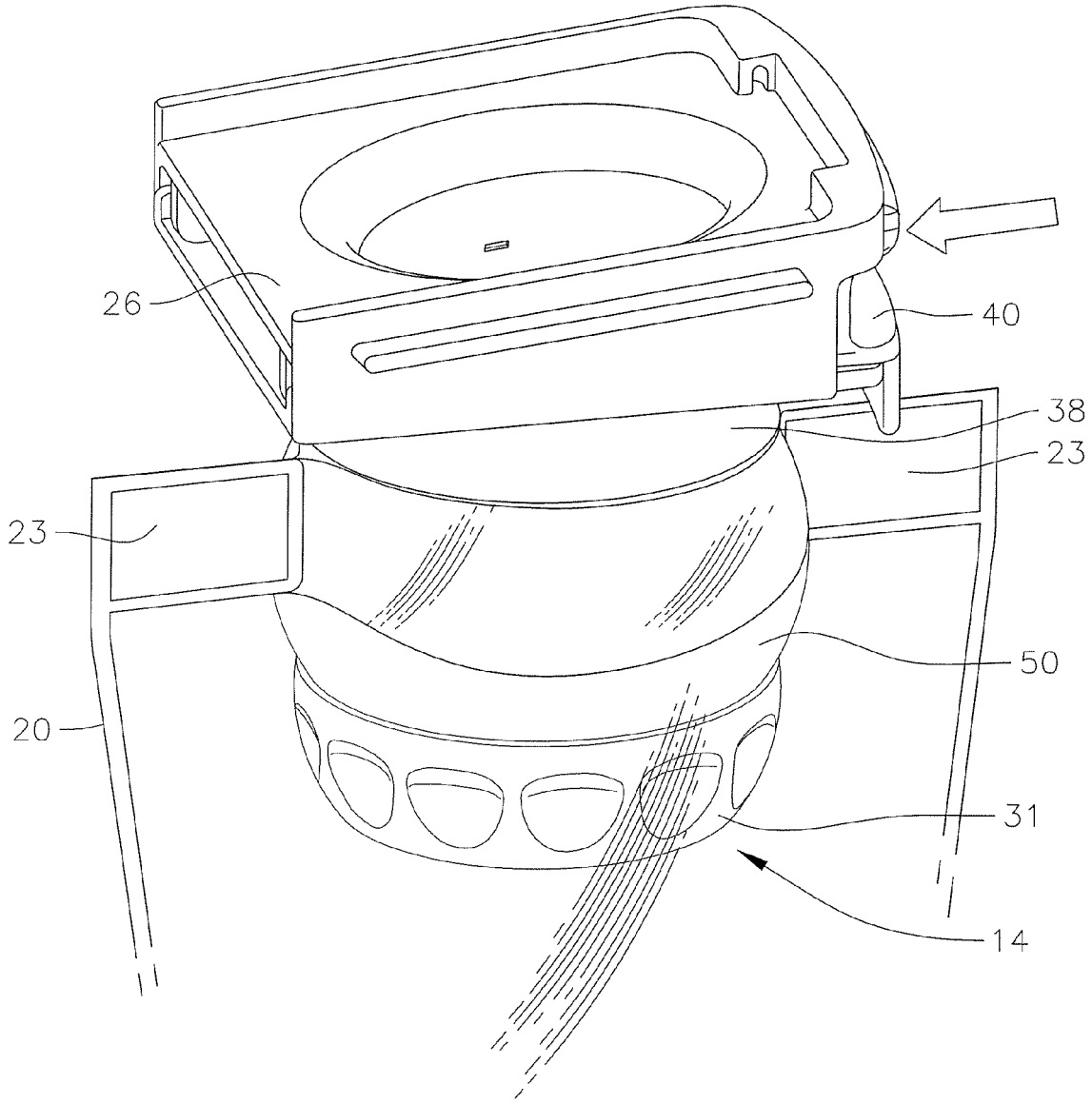
FIG. 9 is a perspective view of the adapter of FIG. 5 in a coupling orientation according to an embodiment of the present invention.
Figure 10:
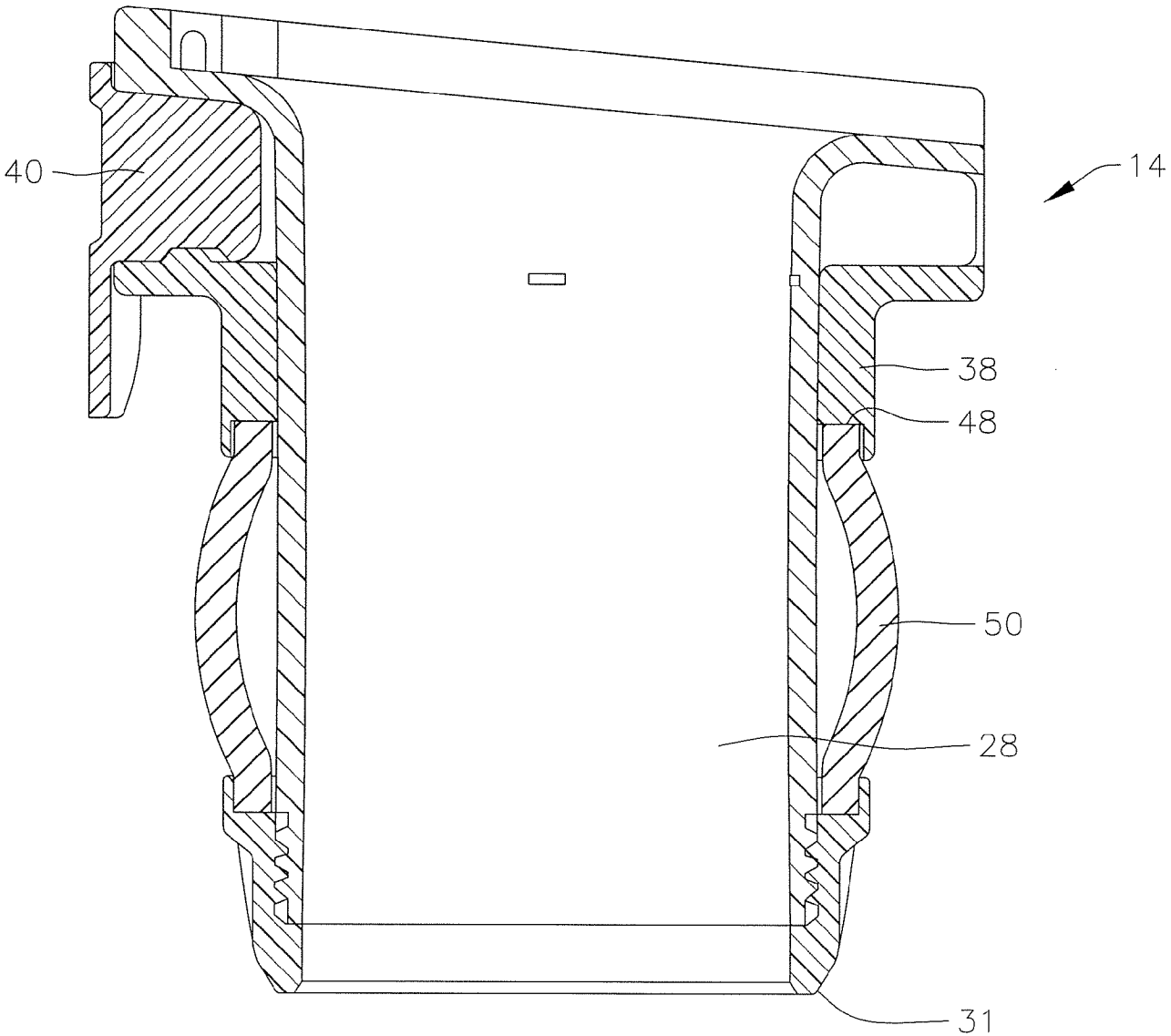
FIG. 10 is a cross-sectional view of the adapter of FIG. 5 in the coupling orientation.

With reference also to FIGS. 8-10, the sleeve 50 is located around a periphery of the arm 28 and between the collar 38 and the stopper 31. As noted above, the sleeve 50 is configured to interface between the adapter 14 and the container 12 to couple the adapter to the container. In one embodiment, the sleeve 50 is made from a relatively flexible material that also provides a reliable friction fit with resin plastic, but at the same time can slide along the rigid surface of the aim 28. Specifically, the sleeve 50 may be made from silicon, but it will be appreciated that the material of the sleeve is not limited thereto. The sleeve 50 is supported on a first side (e.g., a lower side) by the stopper 31, and more specifically, may be wedged between the arm 28 and an annular recess 33 of the stopper to prevent the sleeve from being forced over an exterior edge of the stopper. Further, the sleeve 50 is supported on a second side (e.g., an upper side) by the collar 38, and more specifically, may be wedged in the shoulder 48 between the arm 28 and the neck 44 to prevent the sleeve from being forced over an exterior edge of the collar 38. As noted above, the shoulder 48 of the collar 38 abuts the sleeve 50 and can be used to apply a compressive force thereto. The sleeve may either be fixedly attached to one or both the collar 38 and the stopper 31 or coupled to neither.

The dispenser 10 can be moved between an insertion orientation (FIGS. 6 and 8) and a coupling orientation (FIGS. 9 and 10). In the insertion orientation, in which the adapter 14 is configured to receive the container opening 25, the sleeve 50 is generally parallel to the arm 28 such that an outer periphery of the sleeve is substantially flush with or slightly recessed from an outer periphery of the stopper 31 and/or the collar 38 such that the container 12 can be inserted along the arm. In the coupling orientation, in which the adapter 14 is configured to remain coupled to the container 12, the sleeve 50 is compressed along the longitudinal axis and therefore expands along the lateral axis such that at least a portion of the outer periphery of the sleeve protrudes past the outer periphery of the stopper 31 and the collar 38. Accordingly, in the coupling orientation, the sleeve 50 can contact the container 12 and fixedly couple the container to the adapter 14.

Figure 11:
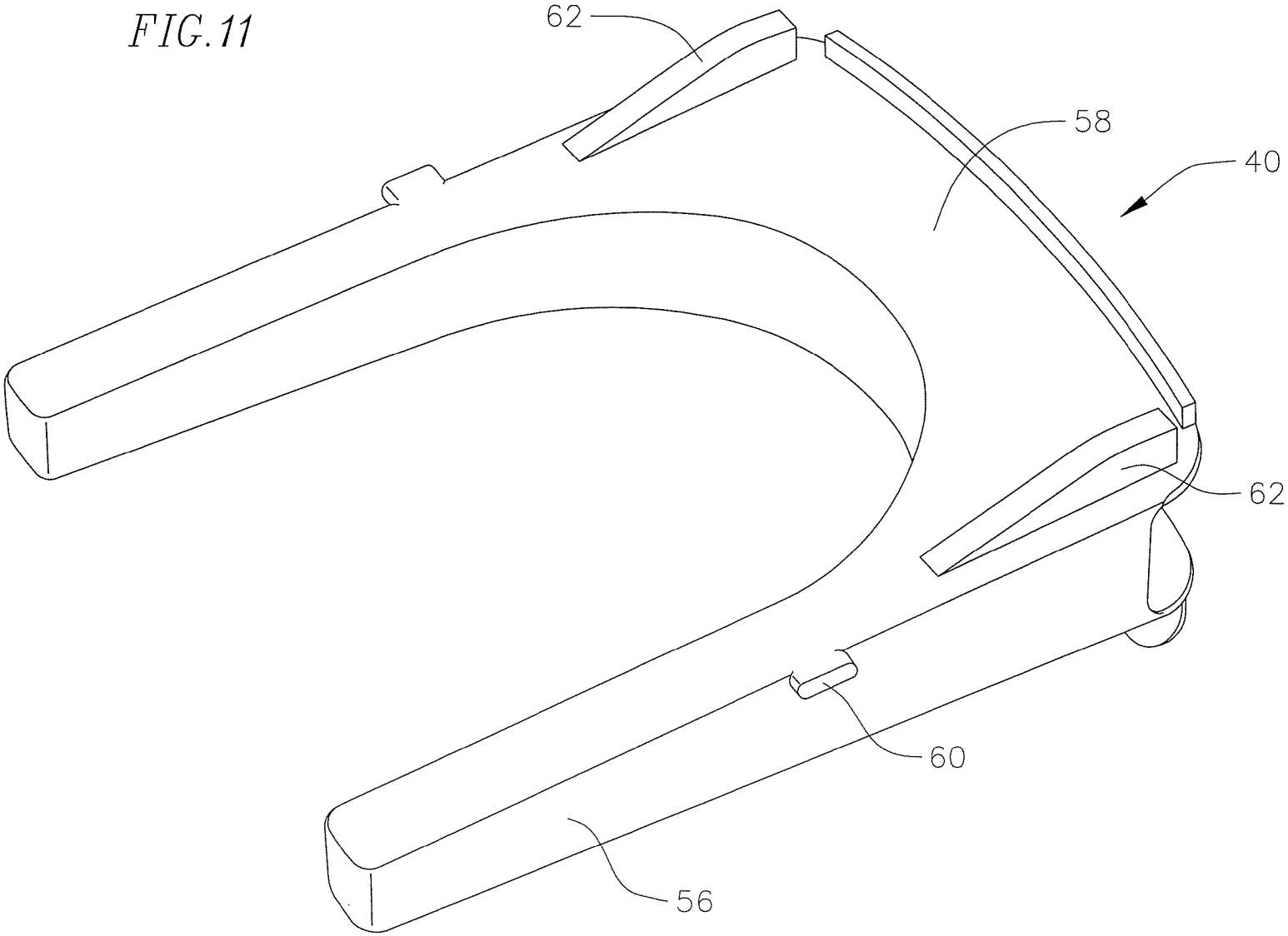
FIG. 11 is a perspective view of an actuator of the adapter of FIG. 5 according to an embodiment of the present invention.

With reference now also to FIG. 11, the actuator 40 is provided to move the adapter 14 between the insertion orientation and the coupling orientation. In one embodiment, the actuator 40 is a generally U-shaped fork having two tines 56 extending from a handle 58, wherein a thickness of the tines is reduced in a direction extending away from the handle. In other words, the tines 56 are thickest near the handle 58 such that the further the actuator 40 is pushed into the adapter 14, the more the collar 38 is moved down towards the stopper 31. The U-shape of the actuator 40 allows the actuator to be inserted into the channel 39 while accommodating the arm 28 between the tine 56. However, the actuator is not limited to the specific shape described herein, but rather may be any suitable shape to actuate the collar 38. In one embodiment, a pair of wedge-shaped ramps 62 are located on each tine 56 proximate a trailing edge of the actuator 40 and providing for additional leverage to moved the collar 38.

In one embodiment, the actuator 40 further includes a pair of retaining lugs 60 extending outwardly in opposite directions from each of the tines 56. The retaining lugs 60 are configured to engage the detents 45 in the adapter to prevent the actuator 40 from being uncoupled from the adapter 14. As such, the actuator 40 can be moved with respect to the adapter 14 to influence the collar 38, but cannot be easily unintentionally removed from the adapter. As noted above, a user could uncouple the actuator 40 from the adapter 14 by physically moving the collar 38 downward past the length of the detents 45 and then sliding the actuator between the collar and the detents.

Operation of the dispenser 10 according to an embodiment of the present invention will now be described in detail. As noted above, the dispenser 10 includes a container 12 housing articles 18 therein and having an opening 25 at one end dimensioned to allow the articles to be removed from the container therethrough. Typically, the articles 18 are interleaved together so that they remain connected until a force strong enough to separate the articles from each other is applied to an article. Additionally, although not necessary, a leading article of the interleaved articles can be extended through the container opening 25 before the adapter is coupled to the container.

To couple the adapter 14 to the container 12, the adapter is placed into the opening 25 of the container, and more specifically, the cylindrical aim 28 is inserted through the opening such that the sleeve 50 is generally aligned with interior walls of the opening defined by the side welds 23. The articles 18 may be extended through the opening 30 of the arm 28 such that at least the leading article protrudes through the adapter 14.

Figure 12:
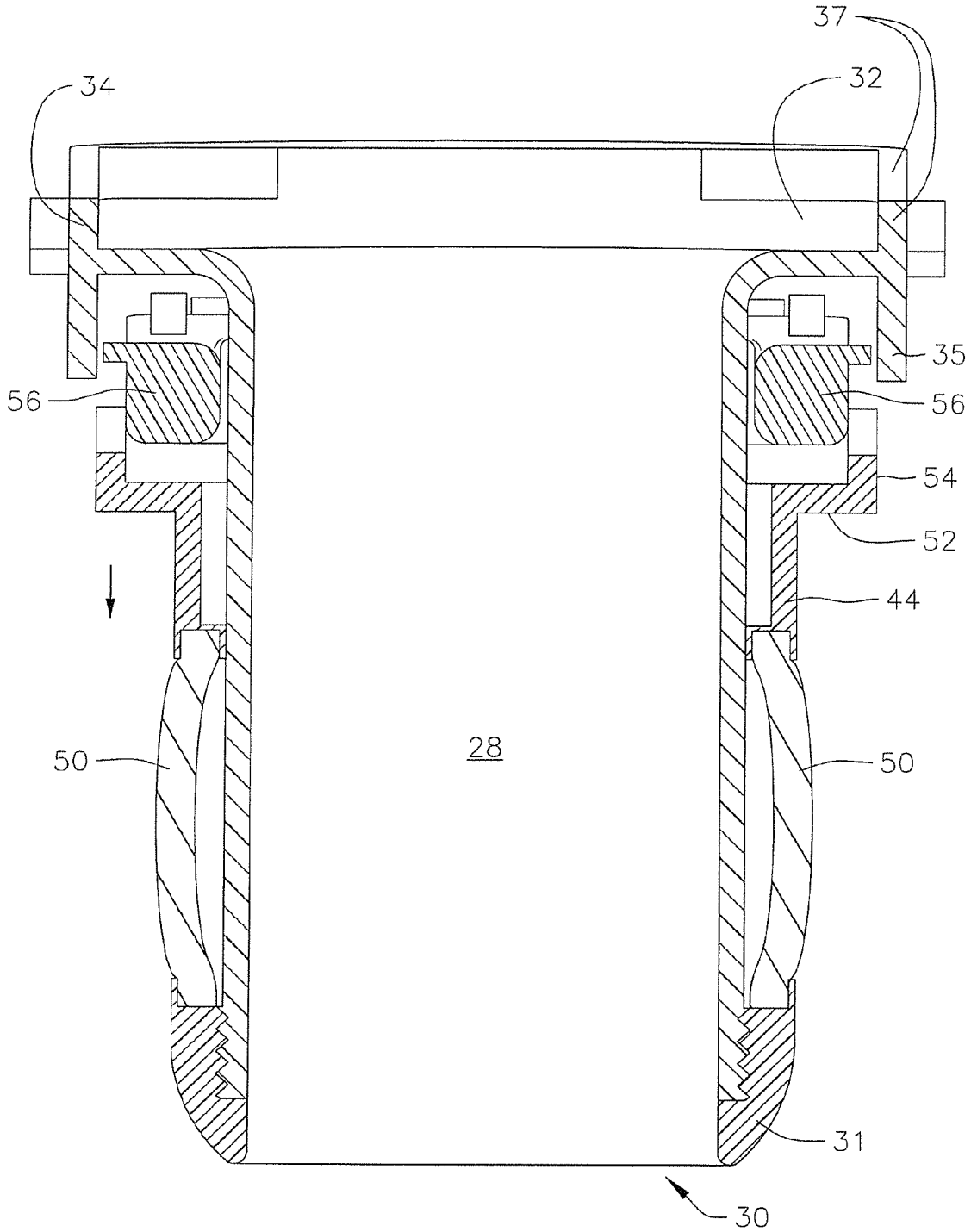
FIG. 12 is a front view of the adapter of FIG. 5 with the actuator inserted therein.

Once the adapter 14 is within the opening 25 as described above, the actuator 40 can be slid within the channel 39 along the planar surface 32 of the base 26 and along the flange 52 of the collar 38. As the actuator 40 moves within the channel with the leading edge of the actuator being the thinnest, the actuator is supported by the stationary surface 32 of the adapter 14 while the increasing thickness of the tines 56 moves the collar 38 generally towards the stopper 31. In other words, the actuator 40 acts like a wedge to drive down the collar 38. As such, the sleeve 50 is compressed along its longitudinal axis and is bent outward along its lateral axis, as also shown in FIG. 12. Accordingly, the sleeve 50 contacts the side welds 23 of the container 12 defining the opening 25 and an interference fit is foamed between the container and the adapter 14, thereby coupling the container 12 and the adapter 14 together (FIG. 9).

Additionally, because the openings 25, 30 of the container 12 and the adapter 14, respectively, are aligned, the articles 18 can be removed from the container through the adapter. To replace a first container 12 with a second container, the actuator 40 is moved from the coupling orientation to the insertion orientation by sliding the actuator in a direction opposite to the insertion direction such that the thinner portion of the tines 56 are located between the collar 38 and the base 26. The bias of the sleeve 50 then pushes the moving collar 38 upward (or otherwise away from the stopper 31), which causes the sleeve to contract along its lateral axis and thereby return the adapter to its insertion position, wherein the sleeve is substantially parallel to the arm 28. As such, the sleeve 50 is disengaged from the container 12 and the adapter 14 and the container can be separated. The container 12 can then be refilled and recoupled to the adapter 14 or a different container can be attached to the adapter 14.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present disclosure as set forth in the following claims.

What is claimed is:

1. A dispenser comprising:

a housing;

an adapter within the housing and configured to be removably coupled to a container, the adapter comprising:

a base having a substantially planar surface and an arm extending from the surface;

a collar on the arm and movable with respect to the arm; and a sleeve on the arm and contacting the collar, wherein the adapter can be moved between an insertion orientation in which the sleeve has a first outer diameter and has a first surface that is directly adjacent the arm and located a first distance from the arm and a coupling orientation in which the sleeve has a second outer diameter that is greater than the first outer diameter and in which a portion of the first surface is located a second distance from the arm, wherein the second distance is greater than the first distance; and an actuator for moving the adapter between the insertion orientation and the coupling orientation, wherein the actuator is generally between the planar surface of the base and the collar when the dispenser is in the coupling orientation.

2. The dispenser of claim 1, wherein the adapter further comprises a stopper on the arm, wherein the sleeve is between the collar and the stopper.

3. The dispenser of claim 2, wherein the stopper has an outer diameter greater than the first outer diameter of the sleeve and smaller than the second outer diameter of the sleeve.

4. The dispenser of claim 1, further comprising a container coupled to the adapter.

5. The dispenser of claim 1, wherein the actuator comprises a handle and a pair of tines.

6. The dispenser of claim 5, wherein the tines narrowingly taper in a direction away from the handle.

7. The dispenser of claim 1, wherein the collar influences the sleeve to change diameters when the adapter is moved between the insertion orientation and the coupling orientation.

8. The dispenser of claim 1, wherein the dispenser has an opening extending therethrough to allow removal of articles from the housing.

9. The dispenser of claim 1, wherein the collar is configured to slide along the arm of the adapter to move between the insertion orientation and the coupling orientation.

10. The dispenser of claim 9, wherein the container is coupled by an interference fit to the adapter in the coupling orientation.

11. The dispenser of claim 9, wherein the container is relatively flexible and has an opening that extends less than an entire width of the container.

12. The dispenser of claim 11, wherein a diameter of the opening is substantially similar to a diameter of the arm of the adapter.

13. The dispenser of claim 9, wherein a portion of the arm is within the container.

14. The dispenser of claim 9, wherein the sleeve contacts the container.

15. A dispenser comprising:

a housing; and an adapter within the housing and configured to be removably coupled to a container, the adapter comprising:

a base having a substantially planar surface and an arm extending from the surface;

a collar on the arm and movable with respect to the arm;

a sleeve on the arm and contacting the collar, wherein the adapter can be moved between an insertion orientation in which the sleeve has a first outer diameter and has a first surface that is directly adjacent the arm and located a first distance from the arm and a coupling orientation in which the sleeve has a second outer diameter that is greater than the first outer diameter and in which a portion of the first surface is located a second distance from the arm, wherein the second distance is greater than the first distance; and an actuator for moving the adapter between the insertion orientation and the coupling orientation, wherein the actuator is configured to move in a transverse direction with respect to the arm.

16. The dispenser of claim 15, wherein the actuator is wedge-shaped.

17. The dispenser of claim 15, wherein the adapter further comprises a stopper on the arm, wherein the sleeve is between the collar and the stopper.

18. The dispenser of claim 15, wherein the stopper has an outer diameter greater than the first outer diameter of the sleeve and smaller than the second outer diameter of the sleeve.

* * * * *